United States Patent [19]

Griffith

[11] Patent Number: 4,572,083

[45] Date of Patent: Feb. 25, 1986

[54] COMBUSTION GAS CLEANING SYSTEM

[76] Inventor: Arval H. Griffith, 424 First Ave. S., Greybull, Wyo. 82426

[21] Appl. No.: 734,859

[22] Filed: May 16, 1985

[51] Int. Cl.[4] ..... F23J 15/00

[52] U.S. Cl. ..... 110/215; 110/216; 55/244; 261/17

[58] Field of Search ..... 110/215, 216, 217; 55/244; 261/17, 98

[56] References Cited

U.S. PATENT DOCUMENTS

| | | | |
|---|---|---|---|
| 3,547,055 | 12/1970 | Zanft | 110/215 |
| 3,548,761 | 12/1970 | Zalman | 110/215 |
| 3,572,264 | 3/1971 | Mercer | 110/215 |
| 3,656,440 | 4/1972 | Grey | 110/216 |
| 3,656,441 | 4/1972 | Grey et al. | 110/216 |
| 3,745,939 | 7/1973 | Allbritton | 110/215 |
| 3,812,793 | 5/1974 | Solomon | 261/17 |
| 3,823,531 | 7/1974 | Crawley | 261/17 |
| 3,932,280 | 1/1976 | Anderson | 110/215 |
| 3,995,567 | 12/1976 | Drake et al. | 110/216 |

*Primary Examiner*—Henry C. Yuen
*Attorney, Agent, or Firm*—Arthur L. Urban

[57] ABSTRACT

A combustion gas cleaning system includes a transferring portion, a treating portion, an impurity collecting portion, an exhaust portion and a liquid purifying portion. The transferring portion includes a substantially horizontal first duct member having one end communicating with a smokestack. A first sprayer is located around the inside periphery of the first duct member. The treating portion includes an elongated substantially vertical chamber, the top of which communicates with the first duct member. The chamber has a plurality of spaced fan members disposed within the chamber transversely along the length thereof. A second sprayer is disposed adjacent each fan member. The impurity collecting portion includes a second horizontal duct member extending from the lower end of the chamber. A liquid reservoir communicates therewith through a plurality of openings in the bottom of the second duct member. The liquid level in the second duct member reduces the cross-sectional area thereof. The exhaust portion includes a generally vertically oriented third duct member extending upwardly from the second duct member. An exhaust deflecting section is disposed on the upper end of the third duct member with a third sprayer located adjacent the deflecting section. The liquid purifying portion includes a liquid receiver communicating with the liquid reservoir and a liquid recirculator to the sprayers of the chamber and the duct members.

17 Claims, 4 Drawing Figures

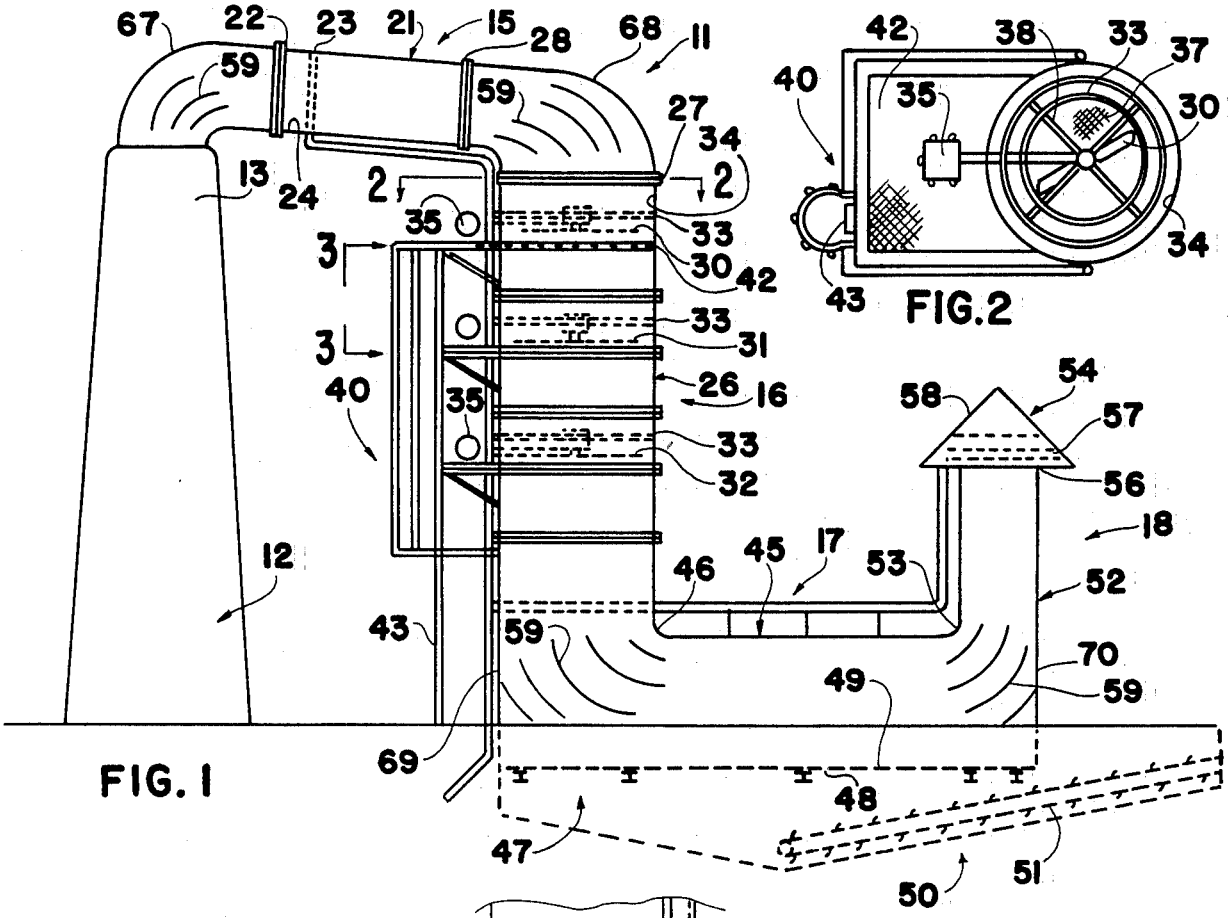
FIG. 1
FIG. 2
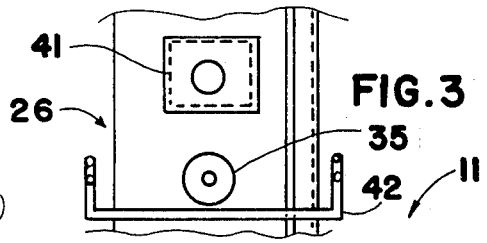
FIG. 3
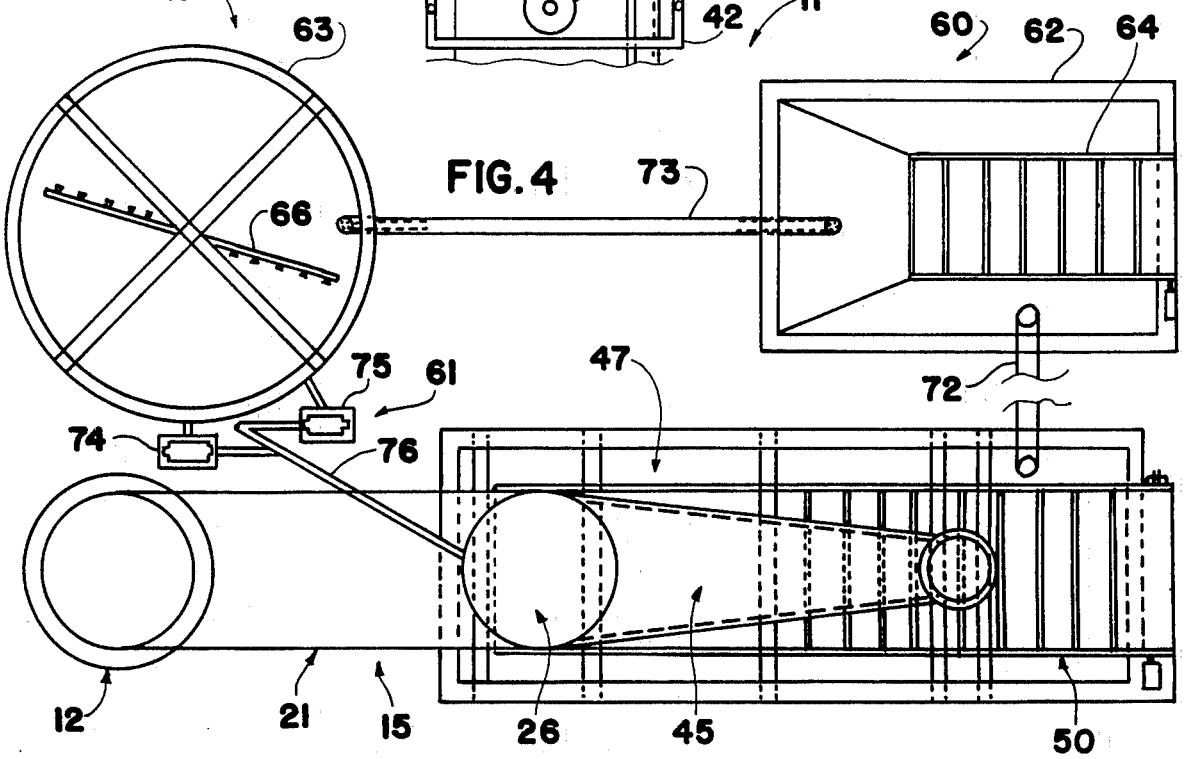
FIG. 4

COMBUSTION GAS CLEANING SYSTEM

This invention relates to a novel cleaning system and more particularly relates to a new system for cleaning combustion gases.

In primitive societies, fires were burned in open areas so the combustion gases simply passed into the atmosphere. Later, as people spent more time inside buildings, methods had to be devised so the combustion gases would not contaminate the rooms. This led to the development of chimnies that carried the hot gases outside.

As civilization became more urbanized, greater care had to be exercised to insure that the combustion gases from one person's dwelling did not pollute the home of a neighbor. This necessitated that regulations be adopted to establish acceptable burning practices.

While residential burning caused some concern, major problems were the combustion gases from industrial activities. Such facilities in the past commmonly burned coal which created a great deal of smoke and soot. In addition to these particulate contaminants, the coal usually contained other impurities such as sulfur and other chemical substances. When such substances were burned, they oxidized to form compounds that were gaseous in nature that mixed easily with the air.

Years ago, only scientists were knowledgeable about such impurities and their combustion products. Ordinary people were only aware of the smoke and soot which were easily visible to the eye. Not only could these materials be seen in the sky, but also particles settled from the air onto exposed surfaces such as houses, cars, as well as personal effects such as laundry, clothing and the like. Since the soil could be washed away easily, people accepted this condition as an inconvenience that was a necessary evil so they could have jobs at the offending manufacturing facility.

In recent years, the contamination of the environment has become a greater concern since studies have shown that the pollutants in the air, water and ground were harmful to the health of human beings as well as other species.

Individuals and various organizations became very concerned about these health problems and heavily publicized them so that after a time a large proportion of the population became aware of the risks involved. This led to pressure to solve the problems primarily through government controls and regulations.

To comply with these new regulations, industries had to change their burning operations. One expedient was to remove the smoke and soot by precipitating the particulate matter from the gases. However, such techniques did not remove the gaseous impurities and so the exhaust gases still created pollution even if it was not apparent to the human eye. Such contaminants could be detected by smell or in some cases by the health problems and other damage that were encountered after exposure to the pollutants.

Much effort and research has been expended in an attempt to remove more completely the various impurities in combustion gases. From these efforts have evolved many different processes and products. Some of them are more efficient than others in removing the impurities. One factor that is common to most proposals is the high cost both in terms of capital expenditure and operating expenses. These high costs have been a serious burden on many companies and drastically reduced their profits, in some cases to the extent that the businesses no longer could be operated at a profit and had to close their doors.

Because of the above factors, many companies have had to restrict their combustion gas cleanup expenditures to a minimum so they could continue to make a profit and stay in business. Although the level of impurities in combustion gases has been reduced significantly even with these limitations, the remaining impurities still can constitute a problem.

From the above discussion, it is clear that previous methods and equipment for removing impurities from combustion gases do not provide a satisfactory solution for many businesses. Thus, there is a need for new apparatus and systems that overcome the shortcomings of earlier expedients.

The present invention provides a novel combustion gas cleaning system with features and advantages not found in previous procedures. The gas cleaning system of the invention provides a simple and convenient means for removing impurities from combustion gases. The system enables the impurities to be removed quickly and relatively inexpensively.

The combustion gas cleaning system of the present invention is simple in design and can be produced relatively inexpensively. Commercially available materials and components can be utilized in its manufacture. Conventional structural fabricating techniques and procedures can be employed in its construction.

The gas cleaning system of the invention can be operated efficiently by semi-skilled labor after a minimum of instruction. The apparatus of the cleaning system is durable in construction and has a long useful life. Little maintenance is required to keep the system in good operating condition.

The system can be adapted to a wide variety of operating conditions and gas compositions. The treating compounds can be recycled after purification. Only small quantities of impurities in solid form need to be discarded.

These and other benefits and advantages of the novel combustion gas cleaning system of the present invention will be apparent from the following description and the accompanying drawings in which:

FIG. 1 is a side elevation of one form of the combustion gas cleaning system of the invention installed adjacent to a smokestack;

FIG. 2 is an enlarged view in section of the treating chamber of the combustion gas cleaning system shown in FIG. 1 taken along line 2—2 thereof;

FIG. 3 is a fragmentary left side view of the treating chamber of the combustion gas cleaning system shown in FIG. 1 taken along line 3—3 thereof; and FIG. 4 is a view from above of the combustion gas cleaning system shown in FIG. 1.

As shown in the drawings, one form of the novel combustion gas cleaning system 11 of the present invention is installed adjacent to a smokestack 12. The system communicates with the top 13 of the stack to receive the combustion gases therefrom and remove the impurities therein so that the gas can be exhausted to the atmosphere without polluting same.

The combustion gas cleaning system 11 of the invention includes a transferring portion 15, a treating portion 16, an impurity collecting portion 17, an exhaust portion 18 and a liquid purifying portion 19.

The transferring portion 15 of the combustion gas cleaning system 11 of the invention includes a first duct member 21. The first duct member 21 is disposed in a substantially horizontal orientation. The first duct member has one end 22 that is affixed to the top 13 of a smokestack 12. Advantageously, the first duct member 21 has a generally circular cross section.

The first duct member 21 is inclined slightly downwardly from the smokestack. The first duct member preferably is inclined downwardly less than about 15° from the horizontal. Most preferably, the first duct member 21 is inclined downwardly from the horizontal between about 2° and 10°.

First spray means 23 is located around the inside periphery 24 of the first duct member 21. The spray means is located intermediate the length of the first duct member. The first spray means is directed toward the axis of the duct member.

The treating portion 16 of the combustion gas cleaning system 11 of the invention includes an elongated chamber 26 which is oriented substantially vertically. The top 27 of the chamber 26 communicates with and is affixed to an end 28 of the first duct member 21 that is remote from the smokestack 12.

The chamber 26 has a generally circular cross section. A plurality of spaced fan members 30, 31 and 32 are disposed within the chamber 26 transversely thereof. Second spray means 33 is disposed adjacent each fan member 30–32. The second spray means 33 is disposed around the inside periphery 34 of the chamber and directed toward the axis of the chamber. Each of the fan members 30–32 is operatively connected to drive means 35. The drive means 35 is located outside the chamber 26.

The fan members 30–32 advantageously include variable speed drives and include protective barriers such as mesh screens 37 adjacent thereto. The fan members preferably are operatively connected to drive means 35 through speed reducers 38.

Access means 40 advantageously is located adjacent each fan member 30–32. The access means 40 preferably includes service doors 41. Platforms 42 are disposed outside the chamber adjacent each service door 41 with a ladder 43 providing accessibility to each platform.

The impurity collecting portion 17 of the combustion gas cleaning system 11 includes a second duct member 45. The second duct member extends from the lower end 46 of the chamber 26 in a generally horizontal orientation.

A liquid reservoir 47 is disposed below the second duct member 45. The second duct member advantageously is suspended above the liquid reservoir 47. The reservoir communicates with the second duct member through a plurality of openings 48 in the bottom 49 of the second duct member. The liquid level in the second duct member reduces the cross sectional area thereof to a smaller size that is more than one-half that of the chamber cross section.

Removal means 50 for the solids is disposed within the liquid reservoir 47. Advantageously, the removal means includes a chain conveyor 51 along the bottom of the reservoir.

The exhaust portion 18 of the combustion gas cleaning system 11 of the invention includes a third duct member 52. The third duct member is oriented generally vertically and extends upwardly from an end 53 of the second duct member 45 that is remote from the chamber 26. The third duct member 52 advantageously extends upwardly a distance significantly less than the height of the chamber. Preferably the height of the third duct member is only about one-half or less the chamber height.

An exhaust deflecting section 54 is disposed on the upper end 56 of the third duct member 52. Third spray means 57 is located outside the third duct member adjacent the deflecting section 54. The exhaust deflecting section 54 advantageously includes a conical cap member 58 that extends beyond the periphery of the third duct member and is spaced therefrom. The third spray means 57 preferably is located in the space between the third duct 52 and the deflecting section 54.

Advantageously, deflecting vanes 59 are disposed within intersections of adjacent components such as the smokestack, duct members and chamber. For example, vanes may be utilized at points where the gases change direction to facilitate the flow thereof through the system.

The liquid purifying portion 19 of the combustion gas cleaning system includes liquid receiving means 60. The liquid receiving means communicates with reservoir 47. The liquid receiving means 60 includes liquid recirculating means 61 for returning purified water back to the first, second and third spray means 23, 33 and 52 of the respective duct members and chamber.

The components of the combustion gas cleaning system 11 of the present invention may be fabricated from a variety of different structural materials. Suitable materials include metals, plastics, wood, concrete, combinations thereof and the like. Where strength is important, steel or alloys ordinarily are employed.

The cleaning system 11 normally may be installed by constructing the liquid reservoir 47, the settling pond 62 and the spray pond 63. Thereafter, the main chamber 26 may be erected over the end of the reservoir closest to the stack 12. Next, the internal and external components of the chamber and the connection thereof are completed.

Then, the first duct member 21 is positioned between the upper ends of the stack and the chamber and joined therewith with suitable units such as elbows 67 and 68. The first spray means 23 is mounted in the first duct and connected into the liquid circulating system.

The second duct member 45 is positioned over the reservoir 47 and connected to the bottom of the chamber 26 through an elbow 69. The third duct member 52 then is erected over the reservoir 47 and connected to the second duct through an elbow 70. The cap member 58 and the third spray means 57 thereafter are mounted in place on the upper end of the third duct. The chain conveyors 51 and 64 as well as the rotatable sprayer 66 are installed in the reservoir and ponds.

In the operation of the combustion gas cleaning system 11 of the invention, the hot combustion gases moving up stack 12 are drawn into the first duct member 21 by the fans 30–32 located in the chamber 26. As the gases move along the first duct 21, they pass through the wall of water formed by the first spray means 23.

The water treated gases from the first duct are drawn downwardly through the chamber 26 and past each of the three circular sprayers 33. Each of the walls of water removes additional impurities from the gases. At the bottom of the chamber, substantially all of the impurities have been entrapped in the water flowing down the chamber.

The air from the bottom of the chamber is forced by the fan members 30–32 into the second duct member 45. Since the second duct is smaller in cross section than the chamber, the liquid in the gases will pass into liquid in the reservoir 47 located at the bottom of the duct and be retained therein. The rate of gas flow through the system created by the speed of the fans is controlled to insure that the fire is not drawn up the stack from the combustion chamber thereof (not shown).

The gases continue along the second duct above the liquid surface and then up the third duct member 52. At the top of the duct 52, gases pass through the circular space between the duct and the cap 58 and into contact with the third spray means 57 where any remaining impurities are entrapped in the water. The water then runs along the outside of the third duct and into the open area of the reservoir 47.

Solids in the water entering the reservoir 47 settle to the bottom and periodically are removed therefrom with the chain conveyor 51. The liquid passes through a conduit 72 into settling pond 62 where any remaining entrapped solids settle to the bottom and are removed with second chain conveyor 64. The liquid in pond 62 then passes through a conduit 73 to a spray pond 63 including rotating sprayer 66 which aerates the water to provide final purification thereof. The pure water is recycled back to the first, second and third spray means 23, 33 and 57 for the treatment of combustion gases moving through the ducts and chamber. This is accomplished with a primary pump 74 and a backup pump 75 through conduit 76.

The above description and the accompanying drawings show that the present invention provides a novel combustion gas cleaning system with features and advantages not found in previous procedures. The system of the invention enables impurities to be removed from stack gases quickly, completely and inexpensively. Treating materials can be recycled after purification so only small quantities in solid form need to be discarded.

The combustion gas cleaning system of the present invention is simple in design and relatively inexpensive. Commercially available materials and components and conventional structural procedures and semi-skilled labor can be employed in its fabrication. The system is durable in construction and requires little maintenance. The system can be adapted to a variety of operating conditions and gas formulations.

It will be apparent that various modifications can be made in the particular combustion gas cleaning system described in detail above and shown in the drawings within the scope of the present invention. The size, configuration, number and arrangement of components can be changed to meet specific requirements. Additional ponds can be included if desired. Also, the proximity of the system to the stack can be different to utilize space around the stack. These and other changes can be made in the combustion gas cleaning system provided the functioning and operation thereof are not adversely affected. Therefore, the scope of the present invention is to be limited only by the following claims.

What is claimed is:

1. Combustion gas cleaning system including a transferring portion, a treating portion, an impurity collecting portion, an exhaust portion and a liquid purifying portion; said transferring portion including a substantially horizontal first duct member, said first duct member having one end communicating with a smokestack, said first duct member being inclined downwardly slightly from said smokestack, first spray means located around the inside periphery of said first duct member intermediate the length thereof and directed toward the axis thereof; said treating portion including an elongated substantially vertical chamber, the top of said chamber communicating with an end of said first duct member remote from said smokestack, said chamber having a generally circular cross section, a plurality of spaced fan members disposed within said chamber transversely along the length thereof, second spray means disposed adjacent each fan member, said second spray means being disposed around the internal periphery of said chamber and directed toward the axis thereof, each of said fan members being operatively connected to drive means located outside said chamber; said impurity collecting portion including a second horizontal duct member extending from the lower end of said chamber, a liquid reservoir disposed below said second duct member and communicating therewith through a plurality of openings in the bottom of said second duct member, the liquid level in said second duct member reducing the cross-sectional area thereof to an area more than one-half that of said chamber cross section, solids removal means disposed within said liquid reservoir; said exhaust portion including a generally vertically oriented third duct member extending upwardly from an end of said second duct member remote from said chamber, an exhaust deflecting section disposed on the upper end of said third duct member, third spray means located outside said third duct member adjacent said deflecting section; said liquid purifying portion including liquid receiving means communicating with said liquid reservoir and liquid recirculating means to said spray means of said chamber and said duct members; whereby impurities in combustion gases passing through said chamber are removed by said spray means and are collected in said liquid reservoir.

2. Combustion gas cleaning system according to claim 1 wherein said first duct member has a generally circular cross section.

3. Combustion gas cleaning system according to claim 1 wherein said first duct member is inclined downwardly from said smokestack less than about 15° from the horizontal.

4. Combustion gas cleaning system according to claim 1 wherein said first duct member is inclined downwardly from said smokestack between about 2° and 10°.

5. Combustion gas cleaning system according to claim 1 wherein said fan members are variable speed.

6. Combustion gas cleaning system according to claim 1 wherein said fan members include protective barriers adjacent thereto.

7. Combustion gas cleaning system according to claim 6 wherein said protective barriers are screens.

8. Combustion gas cleaning system according to claim 1 wherein said fan members are operatively connected to said drive means through gear reducers.

9. Combustion gas cleaning system according to claim 1 including access means adjacent each fan member.

10. Combustion gas cleaning system according to claim 1 wherein said second duct member is suspended above said liquid reservoir.

11. Combustion gas cleaning system according to claim 1 wherein said solids removal means within said liquid reservoir includes chain conveying means.

12. Combustion gas cleaning system according to claim 1 wherein said third duct member extends upwardly for a distance only a fraction of the height of said chamber.

13. Combustion gas cleaning system according to claim 1 wherein said exhaust deflecting section includes a conical cap member that extends beyond the periphery of said third duct member and is spaced therefrom.

14. Combustion gas cleaning system according to claim 13 wherein said third spray means is located in the spacing between said third duct member and said cap member.

15. Combustion gas cleaning system according to claim 1 including deflecting vanes disposed within the intersections of said smokestack, duct members and chamber.

16. Combustion gas cleaning system according to claim 1 wherein said liquid purifying portion includes settling and spray ponds.

17. Combustion gas cleaning system according to claim 16 wherein said settling pond includes chain conveying means.

* * * * *